US007770759B2

(12) United States Patent
Pennaneac'h

(10) Patent No.: US 7,770,759 B2
(45) Date of Patent: Aug. 10, 2010

(54) LIQUID DISPENSER DEVICE

(75) Inventor: Hervé Pennaneac'h, Piseux (FR)

(73) Assignee: Valois S.A.S, Le Neubourg (FR)

( * ) Notice: Subject to any disclaimer, the term of this patent is extended or adjusted under 35 U.S.C. 154(b) by 495 days.

(21) Appl. No.: 11/905,019

(22) Filed: Sep. 27, 2007

(65) Prior Publication Data

US 2008/0073380 A1 Mar. 27, 2008

Related U.S. Application Data

(60) Provisional application No. 60/860,222, filed on Nov. 21, 2006.

(30) Foreign Application Priority Data

Sep. 27, 2006 (FR) ..... 06 53967

(51) Int. Cl.
*B05B 11/00* (2006.01)

(52) U.S. Cl. ..... 222/321.1; 222/321.2; 222/321.7

(58) Field of Classification Search ..... 222/320, 222/321.1, 121.2, 121.3, 321.7
See application file for complete search history.

(56) References Cited

U.S. PATENT DOCUMENTS 5,192,006 A 3/1993 Van Brocklin et al.
7,287,672 B2 * 10/2007 Garcia ..... 222/321.7
7,523,844 B2 * 4/2009 Garcia ..... 222/321.7
7,527,177 B2 * 5/2009 Garcia et al. ..... 222/321.2
2005/0184100 A1 * 8/2005 Garcia et al. ..... 222/321.3
2008/0073379 A1 * 3/2008 Duquet et al. ..... 222/321.2
2009/0026224 A1 * 1/2009 Duquet et al. ..... 222/321.2

FOREIGN PATENT DOCUMENTS

EP 0 025 224 A2 3/1981
EP 0 345 132 A1 12/1989
EP 0 437 139 A1 7/1991
EP 0 530 785 A1 3/1993

* cited by examiner

*Primary Examiner*—Kenneth Bomberg
(74) *Attorney, Agent, or Firm*—Sughrue Mion, PLLC

(57) ABSTRACT

A liquid dispenser device for being associated with a liquid reservoir, said device comprising:

a chamber (10) provided with an inlet valve (5, 15), an outlet valve (27, 32), and a piston (3) that is suitable for varying the volume of the chamber (10);

a liquid dispenser orifice (25); and a pusher (2) that is axially displaceable down and up between a rest position and a depressed position;

the dispenser device being characterized in that the piston (3) includes an elastically-deformable portion (31) that is deformed by the pusher (2) in its depressed position, in such a manner as to open the outlet valve.

8 Claims, 1 Drawing Sheet

LIQUID DISPENSER DEVICE

CROSS REFERENCE TO RELATED APPLICATION

This application claims the benefit under 35 U.S.C. §119 (e) of pending U.S. provisional patent application Ser. No. 60/860,222, filed Nov. 21, 2006, and priority under 35 U.S.C. §119(a)-(d) of French patent application No. FR-06.53967, filed Sep. 27, 2006.

TECHNICAL FIELD

The present invention relates to a liquid dispenser pump that is generally associated with a liquid reservoir, which together constitute a liquid dispenser. It relates to a dispenser member that is generally actuated manually by means of a finger of the user. The liquid is dispensed in the form of a jet of fine spray droplets, a continuous stream, or even a knob of liquid, particularly for viscous liquids, such as cosmetic creams. Such a liquid dispenser member can be used in particular in the fields of perfumery, cosmetics, or even pharmacy for dispensing liquids that are viscous to a greater or lesser extent.

BACKGROUND OF THE INVENTION

The present invention relates more particularly, but not exclusively, to a type of pump that is commonly known as a "pusher-pump". Such a term is explained by the fact that the dispenser member includes a pusher that forms not only a dispenser orifice, but also defines a portion of a liquid chamber in which the liquid is put under pressure in selective manner. In some pumps, an inner surface of the pusher, of generally substantially cylindrical shape, serves as a sealing slide-cylinder for a piston of an outlet valve that is displaced with sealing contact inside the cylinder, thereby uncovering the dispenser orifice in selective manner. In general, the pistons are of the differential type, being displaced in response to a variation in the pressure of the liquid inside the chamber. Thus, in such a pusher-pump, there is a valve piston and a main piston that are displaceable in sealing contact in respective cylinders. The two pistons can be made integrally, and the unit as a whole can be referred to simply by the term "piston" comprising a main-piston lip and an outlet valve lip.

In the prior-art, documents WO 97/23304, U.S. Pat. No. 4,050,613, and WO 2005/063405 are known that all describe pusher-pumps that operate on the above-defined principle. They all describe pumps comprising a pusher, a body that is mounted securely by means of a ring on the opening of a receptacle, and a differential piston that integrates the main-piston and valve-piston functions by forming a main-piston lip and one or two outlet valve lips. The differential piston slides inside the pusher in response to a variation in pressure. The body, the pusher, and the differential piston together form a chamber. When the pressure increases in the chamber, the differential piston is displaced relative to the pusher. In addition, the inlet valve of the chamber is formed by a ball, a deformable-flap valve, or by the differential piston itself.

The problem that is encountered with that type of pump is priming the pump, i.e. filling the chamber for the first time with liquid coming from the reservoir. The above-mentioned prior-art documents do not deal with that problem. Unlike conventional dispensers in which the pump makes it possible to expel the air that is initially contained in the chamber to the inside the reservoir, very often this is not possible with pusher-pumps, since they are mounted on reservoirs of very small capacity. As a result, it is not possible to expel the air that is initially contained in the chamber into the reservoir, since the reservoir is completely full of liquid. Expelling the air into a reservoir of small capacity could result in the pump malfunctioning because of the raised pressure of the liquid stored in the reservoir. Consequently, the prior-art solution cannot be applied to small-capacity reservoirs, such as reservoirs on which pusher-pumps are generally mounted. More generally, an object of the present invention is to prime a liquid dispenser device in simple manner, without an additional step, and at low cost. The solution consisting in expelling the air into the reservoir is not possible.

BRIEF SUMMARY OF THE INVENTION

To achieve these objects, the present invention proposes a liquid dispenser device for being associated with a liquid reservoir, said device comprising a liquid dispenser orifice and a pusher that is axially displaceable down and up between a rest position and a depressed position, a chamber provided with an inlet valve, an outlet valve, and a piston that is suitable for varying the volume of the chamber, the outlet valve comprising a movable valve member and a valve seat, the valve member being secured in displacement with the piston, the piston including an elastically-deformable portion that is deformed by the pusher in its depressed position, in such a manner as to open the outlet valve, the pusher forming the valve seat of the outlet valve, the dispenser device being characterized in that it further comprises a body for being mounted on an opening of a reservoir, the body forming a piston-receiving slide-cylinder defining a free top edge, the piston including a piston lip in leaktight sliding contact in the piston-receiving cylinder, and an annular flange that extends outwards above the top edge of the cylinder, the valve member being formed on the outer periphery of the annular flange, the elastically-deformable portion being formed by the annular flange, the pusher coming to bear against the annular flange when the flange is in abutment against the top edge of the cylinder, thereby deforming the flange and opening the outlet valve. The outlet valve is thus formed between the piston and the pusher, and, in normal operation, the piston is displaced in the pusher in response to an increase in pressure of the liquid in the chamber. However, when there is no liquid in the chamber, as is the situation before it is filled for the first time, the piston is not displaced in the pusher, since it only compresses the air. The pressure in the chamber thus does not reach the necessary threshold to cause the piston to be displaced in the pusher. Thus, in the prior-art documents, actuating the pusher before the chamber is filled for the first time with liquid has the effect only of compressing the air that is stored in the chamber. The outlet valve cannot open since the piston is not displaced in the pusher. Thus, to allow the air that is trapped inside the chamber to escape, it is necessary to push the pusher home and to exert additional pressure so as to deform the elastically-deformable portion of the piston, thereby causing the outlet valve to open, creating an escape passage for the air under pressure in the chamber. When the pressure force on the pusher is relaxed, the outlet valve closes and the pusher returns to its rest position, thereby creating a vacuum inside the chamber making it possible to suck up the liquid coming from the reservoir. The chamber is thus filled with liquid and is ready for the first dispensing.

In an advantageous embodiment, the piston is a differential piston that is suitable for being displaced by the variations in the pressure of the liquid in the chamber, the piston being momentarily out of contact with the pusher. When the pressure in the chamber is less than a predetermined threshold, the piston is advantageously in contact with the pusher by means of a return spring that urges the piston towards the pusher. The pusher advantageously defines a portion of the chamber.

However, the present invention can be applied to other forms of pump, or more generally to dispenser devices in which the piston co-operates with the pusher so as to form an outlet valve.

The outlet valve is thus formed between the piston and the pusher, and, in normal operation, the piston is displaced in the pusher in response to an increase in pressure of the liquid in the chamber. However, when there is no liquid in the chamber, as is the situation before it is filled for the first time, the piston is not displaced in the pusher, since it only compresses the air. The pressure in the chamber thus does not reach the necessary threshold to cause the piston to be displaced in the pusher. Thus, in the prior-art documents, actuating the pusher before the chamber is filled for the first time with liquid has the effect only of compressing the air that is stored in the chamber. The outlet valve cannot open since the piston is not displaced in the pusher. By means of the present invention, it is possible to deform the piston with the pusher.

Advantageously, the pusher comprises a top plate on which a user can exert pressure by means of a finger, and a peripheral skirt forming the dispenser orifice, the plate forming the outlet valve seat and an annular bearing rim for coming to bear against the flange so as to deform it, the rim being situated radially outside the top edge of the cylinder. The flange that is advantageously of annular shape thus comes into abutment at its inner periphery against the top edge of the cylinder, and it is pressed downwards at its outer periphery by the pusher that advantageously forms a bearing rim. The flange is thus forced to flex a very little, but that suffices to lift the outlet valve member off its seat, thereby creating an escape passage for the air under pressure in the chamber.

In an advantageous embodiment that can be implemented independently of the characteristics that make it possible to prime the pump, the piston includes a flexible membrane, and an anchor collar that is engaged with the pusher, the membrane connecting the valve member to the collar, defining an outlet channel for the liquid as far as the dispenser orifice. It can be envisaged to use such a piston (comprising a piston lip, an outlet valve member, a flexible membrane, and an anchor collar that is engaged with the pusher) without a deformable flange.

According to another characteristic of the invention, the deformable portion presents resistance to deformation that is greater than the force exerted by the spring, and greater than or equal to the maximum pressure existing in the chamber.

A principle of the invention is to deform the piston locally so as to force the outlet valve to open. It is thus possible to allow the air under pressure in the chamber to escape, and to allow the device to be primed. In normal dispensing use, deformation of the piston normally does not occur. And even in the event of deformation, that has no consequence on the dispensing of the liquid. This is explained by the fact that the forced opening of the outlet valve by deforming the piston takes place in the depressed position by exerting a force that is greater than the normal operating force of the device. Even if the user presses down very hard on the pusher the piston will deform, but since the pump chamber is empty, nothing is dispensed.

BRIEF DESCRIPTION OF THE DRAWINGS

The invention is described more fully below with reference to the accompanying drawings which show an embodiment of the invention by way of non-limiting example.

In the figures.

DETAILED DESCRIPTION

Figure 3:
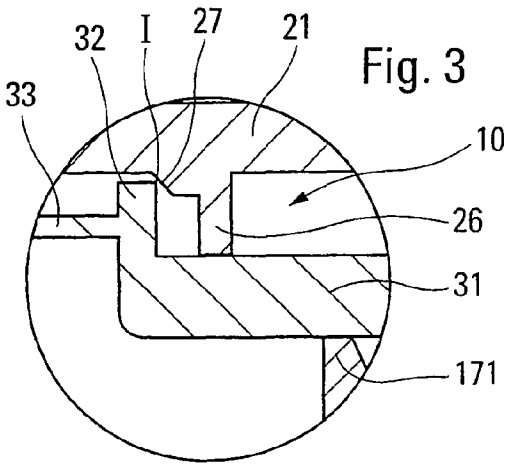
FIG. 3 is a much larger-scale view of a detail A of FIG. 2.

The dispenser device of the figures is a pump that is shown associated with a receptacle R including a neck C on which the dispenser device of the invention is fastened.

The pump comprises five component elements, namely a body 1, a pusher 2, a piston 3, a spring 4, and an inlet valve member 5. The pump can further comprise a dip tube 6. The body, the pusher, the piston, the valve member 5, and the dip tube 6 are preferably made by molding a plastics material. The pump includes a pump chamber 10.

The body 1 includes a fastener ring 11 that co-operates with the neck C, so as to fasten the pump on the receptacle R. The ring 11 is engaged with the outside of the neck. In addition, the body forms a self-sealing lip 12 that is in leaktight engagement with the inside wall of the neck. The body 1 also forms a guide bushing 14. The body also forms a main piston-receiving cylinder 17 that internally defines a leaktight sliding surface having a function that is explained below. The cylinder 17 defines a free top edge 171 that serves as an abutment for the piston, as explained below. The body also forms an inlet sleeve 16 that forms an inlet valve seat 15. The dip tube 6 is connected to the sleeve 16 that has an inlet duct 18 passing therethrough. The inlet sleeve 16 extends below the cylinder 17 and is cylindrical about the same axis.

The body 1 is circularly symmetrical about an axis X that extends longitudinally along the central axis of the inlet duct 18.

This is a particular design for a particular body of a dispenser device constituting an embodiment of the invention. Naturally, the body can present characteristics other than the characteristics described above, without going beyond the ambit of the invention.

The pusher 2 forms a dispenser head for the pump. The pusher 2 comprises a bearing plate 21, and a peripheral skirt 22 that extends downwards from the outer periphery of the bearing plate. Thus, the pusher 2 is generally in the shape of an upsidedown bucket, with the bearing plate forming its bottom, and the skirt forming its cylindrical side wall. However, the skirt is not necessarily of cylindrical shape. It could present sections that are frustoconical or rounded.

The bearing plate 21 includes a bearing zone 211 on which it is possible to press by means of one or more fingers. On its bottom wall, the plate 21 forms an annular bearing rim 26, and an annular seat 27 for the outlet valve. In this embodiment, the seat is formed by widening the rim outwards.

The skirt 22 comprises a top dispenser wall 23 and a bottom guide wall 24. The top end of the dispenser wall 23 is connected to the outer periphery of the bearing plate 21. The dispenser wall 23 is formed with a through dispenser orifice 25 that extends between its inner and outer surfaces. The dispenser orifice 25 can open out to the outer surface in a diffuser dish 251.

The guide wall 24 includes an abutment bead 241 on its inner surface for co-operating with the guide bushing 14. The abutment bead 241 makes it possible to secure the pusher to the body, with said pusher thus being axially displaceable over no more than a determined maximum stroke.

In the embodiment selected to illustrate the invention, the piston 3 comprises a lip 36 that is engaged to slide in leaktight manner inside the cylinder 17, an axial rod 35 through which there passes a connection channel 37, a radial annular flange 31 that extends outwards from the rod above the edge 171 of the cylinder 17, a valve member 32 for the outlet valve, a flexible membrane 33, and an anchor collar 34. More precisely, the lip 36 is formed at the bottom end of the axial rod 35. The connection channel 37 passes through the rod 35 in substantially axial manner. The flange 31 is located at the top end of the rod 35. The diameter of the rod 35 is slightly smaller than the inside diameter of the cylinder 17. The inner edge of the flange 31 is situated just above the edge 171 of the cylinder 17. The valve member 32 for the outlet valve is formed at the outer periphery of the flange 31. The valve member can be in the form of an annular rib that is adapted for selectively coming into sealing contact with the seat 27 formed by the plate 21 of the pusher 2. In the rest position shown in FIG. 1, the return spring 4 pushes the flange 31 towards the plate 21, such that the rib 32 is pressed against the seat 27. The outlet valve is thus closed. The return spring 4 bears firstly against the body 1, and secondly under the flange 31. The spring 4 is disposed around the cylinder 17. The anchor collar 34 comes into leaktight clamping engagement against the dispenser wall 23 of the skirt 22 of the pusher 2. The anchor collar 34 is thus secured to the pusher 2. The anchor collar 34 is annular and is situated below the dispenser orifice 25. The flexible membrane 33 connects the anchor collar 34 to the flange 31. An outlet channel 28 is thus formed between the pusher and the membrane 33. This channel puts the outlet valve 32, 27 into communication with the dispenser orifice 25. The outlet channel 28 presents an annular configuration.

Instead of the membrane 33 and the collar 34, an outlet valve lip can be provided that slides in leaktight manner inside the pusher.

Figure 2:
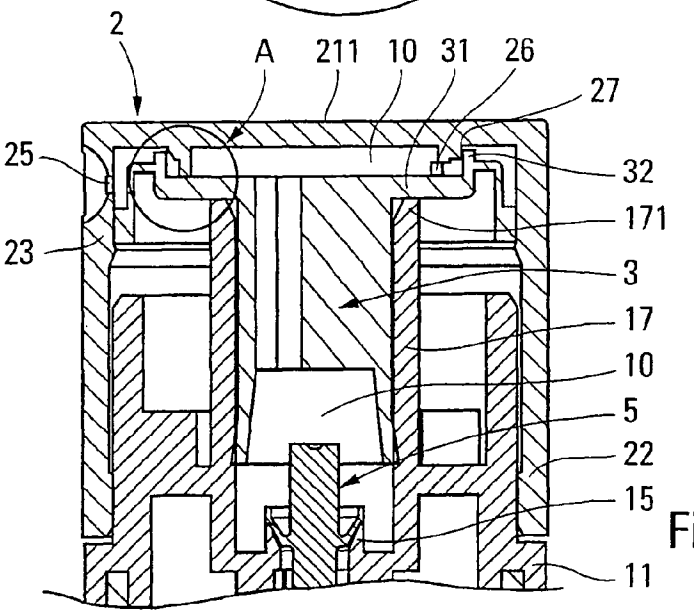
FIG. 2 is a view similar to the view in FIG. 1 but shown in the depressed position.

In the invention, a portion of the piston 3 is made in such a manner as to be elastically deformable. Naturally, this does not apply to the flexible membrane 33. In the embodiment used to illustrate the present invention, the elastically-deformable portion is formed by the flange 31 that connects the rod 35 to the valve member 32 of the outlet valve. The flange 31 is caused to deform, and more particularly to flex, when the pusher 2 bears against the flange 31 while said flange is in abutment against the free top edge 171 of the cylinder 17, as can be seen in FIG. 2 or 3. More particularly, it is the bearing rim 26 that comes to bear against the top wall of the flange 31 when its bottom wall is in abutment against the edge 171. It should be observed that the rim 26 is situated radially further out than the edge 171, such that the flange 31 is deformed by flexing downwards at its outer periphery. However, it is specifically at its outer periphery that the rib serving as an outlet valve member 32 is formed. Consequently, flexing the flange 31 by pressing the rim 26 causes the outlet valve to open a little by means of the rib 32 lifting off its seat 27, as can be seen in FIG. 3. The flexing of the flange 31 is not visible in FIG. 2: it is not necessary for the outlet valve to be wide open. On the contrary, a small gap that is not visible to the naked eye is sufficient to allow the air under pressure in the chamber to escape into the outlet channel 28 so as to reach the orifice 25. The gap that is not visible is designated in FIG. 3 by the letter I.

The body 1, the pusher 2, and the piston 3 together form a pump chamber 10 that extends continuously inside the main cylinder 17, through the connection channel 37, and between the plate 21 and the flange 31. In the rest position shown in FIG. 1, the spring 4 pushes the piston 3 into abutment against the pusher. More precisely, the spring pushes the valve member 32 against the seat 27. The rim 26 of the plate 21 comes into contact lightly against the flange, without disturbing the sealing contact of the outlet valve. The rim can even be a lifted off the flange a little. The inlet valve is closed.

By exerting a force on the bearing zone 211, the pusher is displaced axially relative to the body 1, entraining the piston. Initially, the displacement of the pusher causes the inlet valve to be pressed down. The pump chamber 10 is thus isolated from the reservoir R. From that moment on, the liquid in the pump chamber 10 is put under pressure. As a result of the liquid being incompressible, the total working volume of the pump chamber must necessarily remain constant. But since the main piston 36 is pushed down into the cylinder 17, thereby reducing the volume of the bottom portion of the chamber, a new volume must be created. This is possible as a result of the differential piston moving away from the bearing plate 21. This causes the valve member to lift off its seat and thus open the outlet valve. The liquid under pressure in the pump chamber thus finds an outlet passage to the dispenser orifice. The passage remains open for as long as the pressure inside the chamber is able to overcome the force of the spring 4. The depressed position is reached when the flange 31 comes into abutment against the edge 171 of the cylinder. The chamber 10 is then at its minimum volume.

Figure 1:
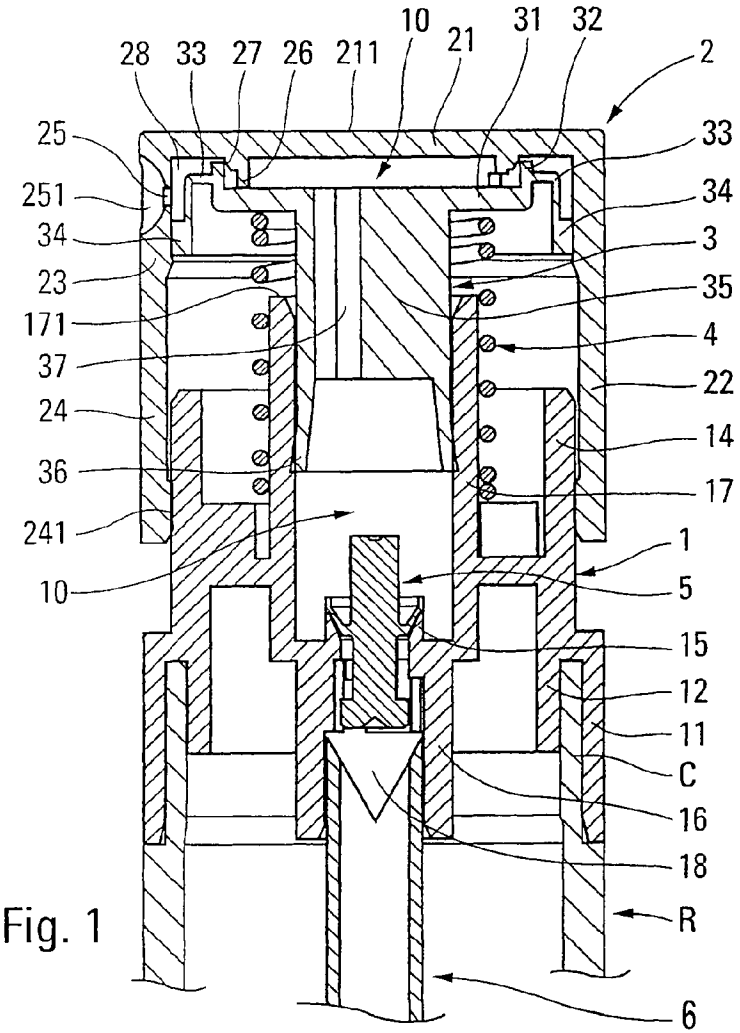
FIG. 1 is a vertical section view through a dispenser device constituting an embodiment of the invention and shown in the rest position.

When the pressure inside the chamber drops below a certain threshold, the spring 4 pushes the piston towards the rest position shown in FIG. 1. Once again, the outlet valve is thus closed. The displacement of the valve member, the rod, and the lip is made possible by the presence of the flexible membrane 33 that functions as a flexible connection between the movable flange and the stationary anchor collar 34. In normal operating (dispensing) conditions, only the flexible membrane is caused to deform, the flange is not deformed. Such a piston having an outlet valve and a flexible membrane constitutes a characteristic that can be protected in itself, i.e. regardless of whether the flange is deformable in order to perform priming. This corresponds to a normal operating cycle for the pump once it has been primed, i.e. with its chamber full of liquid.

In contrast, when the chamber 10 does not contain any liquid and is full only of air, which is the situation before it is used for the first time after manufacture and assembly, the operating cycle is not possible, given that the pressure inside the chamber has not reached the threshold that is sufficient and necessary to displace the piston inside the pusher. Air is a compressible medium in contrast to liquids that are incompressible. It is thus possible to actuate the pusher without the chamber being emptied of its air. This is the situation with prior-art devices, but this drawback is remedied in the present invention by the presence of the elastically-deformable flange 31 of the piston. With reference once again to FIG. 2, the pump can be seen in its depressed position, with its spring 4 compressed to its maximum. The bottom end of the skirt is spaced apart from the fastener ring of the body. Thus, by pressing down hard on the plate 21 of the pusher 2, the rim 26 bears hard against the flange, in such a manner as to cause the outside of said flange to flex downwards. The outlet valve opens and the chamber 10 is emptied of the air that was initially trapped inside. The skirt of the pusher can then come into abutment against the fastener ring 11 of the body. When the bearing force decreases, the flange 31 returns to its non-deformed state, which once again closes the gap I between the rib 32 and the seat 27. The chamber is thus once again isolated from the outside, and a vacuum is created as the spring 4 relaxes so as to return the piston and the pusher to the rest position of FIG. 1. The vacuum generated causes the valve member 5 of the inlet valve to rise, and liquid coming from the reservoir is then able to rise through the dip tube 6 and penetrate into the chamber 10 that begins to fill with liquid for the first time.

The flange 31 advantageously presents resistance to deformation that is greater than the force exerted by the spring 4, and greater than or equal to the maximum pressure existing inside the chamber 10. It is preferable for the flange not to deform under normal operating conditions of the pump. In other words, once the pump is primed, the user normally no longer needs to deform the flange when pressing on the pusher so as to dispense the liquid. For this, it suffices to make the flange with sufficient wall thickness. Naturally, if the user presses very hard on the pusher in the depressed position, the flange will deform, but said deformation will have no effect on the operation of the pump, given that the pump chamber 10 will already have been emptied of its content. By releasing the bearing force, the flange initially returns to its non-deformed position, and it is only after this that the spring 4 begins to relax.

Thus by means of the deformable flange of the piston, it is possible to open the outlet valve, and to create an escape passage for the air that is initially held captive in the pump chamber. In this embodiment, the flange forms the deformable portion. It is also possible to envisage deforming some other portion of the piston, or even the pusher. In addition, in this embodiment, the abutment for the flange is formed by the top edge 171 of the cylinder 17. In a variant, it is possible to use another portion of the device, such as the body or the spring, to provide the abutment for the flange, or to use some other deformable portion of the piston.

The dispenser device can be primed by the user or in the factory. Priming can serve as a first-use indicator.

In this embodiment, the flange presents a plane disk shape. It could present other shapes: frustoconical, stepped, etc.

The invention claimed is:

1. A liquid dispenser device for being associated with a liquid reservoir (R), said device comprising:

a liquid dispenser orifice (25); and a pusher (2) that is axially displaceable down and up between a rest position and a depressed position;

a chamber (10) provided with an inlet valve (5, 15), an outlet valve (27, 32), and a piston (3) that is suitable for varying the volume of the chamber (10), the outlet valve comprising a movable valve member (32) and a valve seat (27), the valve member being secured in displacement with the piston (3), the piston (3) including an elastically-deformable portion (31) that is deformed by the pusher (2) in its depressed position, in such a manner as to open the outlet valve, the pusher (2) forming the valve seat (27) of the outlet valve;

the dispenser device being characterized in that it further comprises a body (1) for being mounted on an opening (C) of a reservoir (R), the body (1) forming a piston-receiving slide-cylinder (17) defining a free top edge (171), the piston (3) including a piston lip (36) in leak-tight sliding contact in the piston-receiving cylinder (17), and an annular flange (31) that extends outwards above the top edge (171) of the cylinder (17), the valve member (32) being formed on the outer periphery of the annular flange (31), the elastically-deformable portion being formed by the annular flange (31), the pusher (2) coming to bear against the annular flange (31) when the flange is in abutment against the top edge (171) of the cylinder, thereby deforming the flange and opening the outlet valve.

2. A dispenser device according to claim 1, in which the piston (3) is a differential piston that is suitable for being displaced by the variations in the pressure of the liquid in the chamber, the piston being momentarily out of contact with the pusher.

3. A dispenser device according to claim 1, in which, when the pressure in the chamber is less than a predetermined threshold, the piston (3) is in contact with the pusher (2) by means of a return spring (4) that urges the piston (3) towards the pusher (2).

4. A dispenser device according to claim 1, in which the pusher (2) defines a portion of the chamber (10).

5. A dispenser device according to claim 1, in which the pusher (2) comprises a top plate (21) on which a user can exert pressure by means of a finger, and a peripheral skirt (22) forming the dispenser orifice (25), the plate (21) forming the outlet valve seat (27) and an annular bearing rim (26) for coming to bear against the flange (31) so as to deform it, the rim (26) being situated radially outside the top edge (171) of the cylinder (17).

6. A dispenser device according to claim 5, in which the piston (3) includes a flexible membrane (33), and an anchor collar (34) that is engaged with the pusher (2), the membrane (33) connecting the valve member (32) to the collar (34), defining an outlet channel (28) for the liquid as far as the dispenser orifice (25).

7. A dispenser device according to claim 1, in which the deformable portion (31) presents resistance to deformation that is greater than the force exerted by the spring, and greater than or equal to the maximum pressure existing in the chamber.

8. A dispenser device according to claim 1, in which the deformable portion (31) of the piston deforms after the pusher has reached its depressed position.

* * * * *